US011938587B2

(12) United States Patent
Tong et al.

(10) Patent No.: US 11,938,587 B2
(45) Date of Patent: Mar. 26, 2024

(54) ANGLE GRINDER AND SHIELD ASSEMBLY THEREOF

(71) Applicant: Nanjing Chervon Industry Co., Ltd., Nanjing (CN)

(72) Inventors: Guoming Tong, Nanjing (CN); Xiang Zhao, Nanjing (CN); Shaojun Wang, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 819 days.

(21) Appl. No.: 16/402,406

(22) Filed: May 3, 2019

(65) Prior Publication Data

US 2019/0358774 A1 Nov. 28, 2019

(30) Foreign Application Priority Data

May 25, 2018 (CN) ..... 201810512882.8
May 25, 2018 (CN) ..... 201820800463.X

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/06; B24B 55/10; B24B 55/102; B24B 23/02; B24B 23/028; B24B 23/026
USPC ..... 451/357–361, 370, 378, 431, 451, 455, 451/458
See application file for complete search history.

(56) References Cited

U.S. PATENT DOCUMENTS 10,556,319 B2 * 2/2020 Iwakami ..... B24B 55/052
2006/0068690 A1 * 3/2006 Koschel ..... B24B 55/052 451/451
2011/0318999 A1 * 12/2011 Boeck ..... B23Q 11/08 451/344
2016/0297052 A1 * 10/2016 Aiken ..... B24B 23/028
2017/0072534 A1 * 3/2017 Nakamura ..... B25F 5/026
2017/0072535 A1 * 3/2017 Iwakami ..... B24B 55/052
2021/0260722 A1 * 8/2021 Otani ..... B24B 23/02

FOREIGN PATENT DOCUMENTS

CN 107263325 A * 10/2017 ..... B25B 55/04

OTHER PUBLICATIONS https://web.archive.org/web/20170222092904/http://www.neonickel.com/alloys/stainless-steels/; hereinafter "Neonickel.com") Date: Feb. 22, 2017. (Year: 2017).*
English Translation of Foreign Patent CN_107263325 (Year: 2017).*

* cited by examiner

*Primary Examiner* — Bryan R Muller
*Assistant Examiner* — Robert C Moore
(74) *Attorney, Agent, or Firm* — Greenberg Traurig, LLP

(57) ABSTRACT

An angle grinder includes a housing, an output shaft at least partially extending out of the housing and being rotatable about a first axis relative to the housing, a sleeve fixedly connected to the housing, a first shield surrounding the output shaft and detachably connected to the sleeve, a second shield surrounding at least a part of the first shield and detachably connected to the first shield, and a connector configured for connecting the second shield to the first shield. The second shield is formed or connected with a mounting element for cooperating with the connector, and the connector and the mounting element are separately formed.

15 Claims, 10 Drawing Sheets

ANGLE GRINDER AND SHIELD ASSEMBLY THEREOF

RELATED APPLICATION INFORMATION

This application claims the benefit under 35 U.S.C. § 119(a) of Chinese Patent Application No. CN 201810512882.8, filed on May 25, 2018, which is incorporated herein by reference in its entirety herein

TECHNICAL FIELD

The present disclosure relates generally to electric tools and, more particularly, to an angle grinder and shield assembly thereof.

BACKGROUND

An angle grinder is an abrasive tool used for cutting and grinding. When in use, there are two general forms of working elements: cutting and grinding discs. Because of the high rotational speed of the angle grinder, when cutting an element using a saw blade, and a pressure is applied or a thick hard material is cut, it is easy for the working element to get stuck, and the saw blade and the cutting disc may be broken into elements which may then be splashed, or the machine may bounce out of control, which may damage items. In order to avoid such dangers, when using the angle grinder, a protective shield is usually installed. However, the structures of the respective shields of the grinding disc and the cutting disc are different, the grinding disc is provided with a semi-protective structure, while the cutting disc is provided with a full protective structure. Commonly in the market, both kinds of protective shields are shipped. When in use, however, for cutting or grinding operations, the protective shield needs to be replaced with a suitable one, which makes the operation very inconvenient.

In addition, when in use, sparks or particles may fly out along a tangent of the cutting disc that rotates at a high speed, resulting in high wear and tear of the shield.

SUMMARY

An angle grinder in accordance with some examples includes a housing, an output shaft at least partially extending out of the housing and being rotatable relative to the housing about a first axis, a sleeve fixedly connected to the housing where the output shaft passes through the sleeve, a first shield surrounding the output shaft and detachably connected to the sleeve, a second shield surrounding at least a part of the first shield that is detachably connected to the first shield, and a connector configured for connecting the second shield to the first shield, wherein the second shield is formed or connected with a mounting element for mounting the connector, and the connector and the mounting element are separately formed.

In some examples, the mounting element is integrally formed with the second shield and the connector and the mounting element are detachably connected to each other.

In some examples, the first shield forms a first space opening toward a direction facing away from the first axis when the first shield is mounted onto the sleeve and a whole of the first shield and the second shield forms a second space that opens in a direction perpendicular to the first axis when the second shield is mounted onto the first shield.

In some examples, the mounting element at least partially inclines toward the first axis and is elastic.

In some examples, the connector is operative to not be displaced relative to the mounting element when the connector is connected to the mounting element.

In some examples, the connector is a metal element.

In some examples, on a surface of the connector is further coated a coating.

In some examples, the connector is formed with a buckle that is connected to the first shield.

In some examples, the connector is operative to be displaced relative to the mounting element when the connector is connected to the mounting element.

In some examples, the mounting element forms a first accommodation space configured for receiving the connector.

An example shield assembly for an angle grinder with an output shaft that is rotatable about a first axis is also described. The shield assembly includes a first shield surrounding the output shaft which is detachably connected to the angle grinder, a second shield surrounding at least a part of the first shield which is detachably connected to the first shield, and a connector configured for connecting the second shield to the first shield wherein the second shield is formed or connected with a mounting element for mounting the connector and the connector and the mounting element are separately formed.

DETAILED DESCRIPTION

Figure 1:
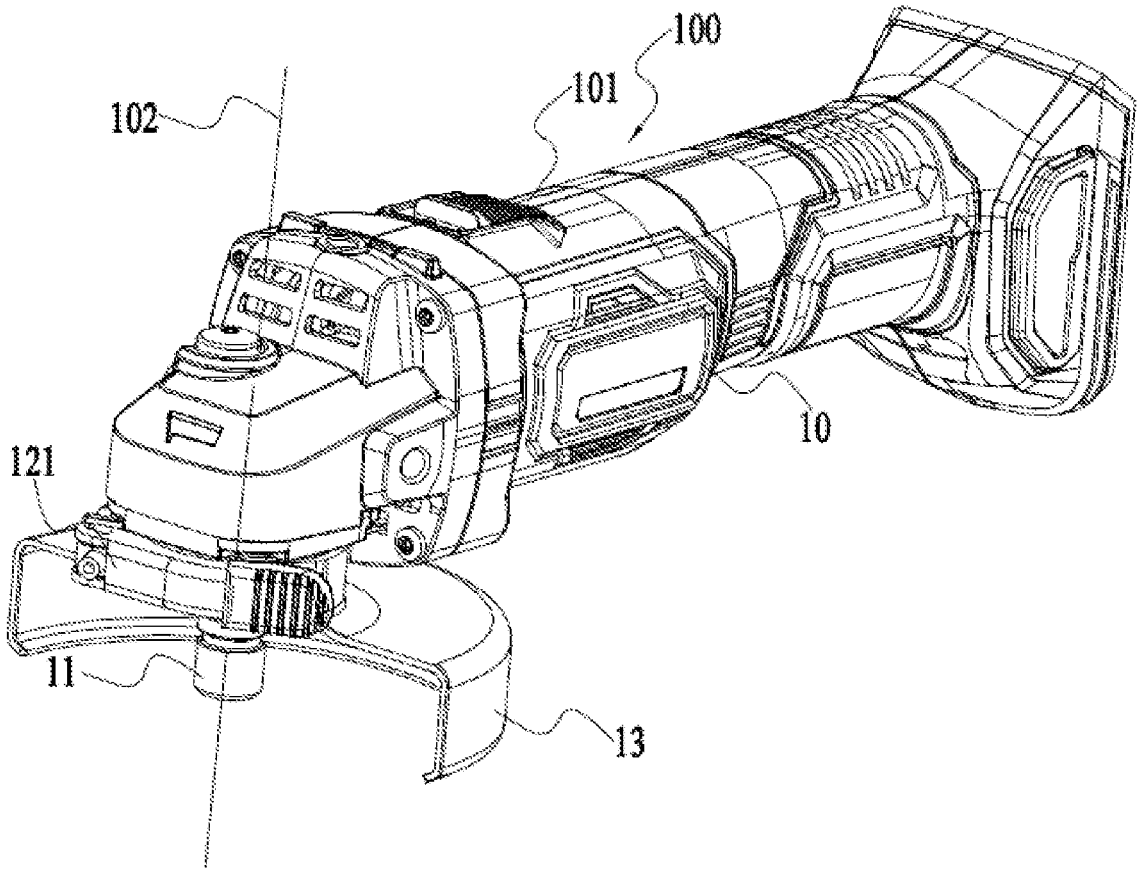
FIG. 1 is a schematic view illustrating an example angle grinder that is fitted with a first shield.
Figure 2:
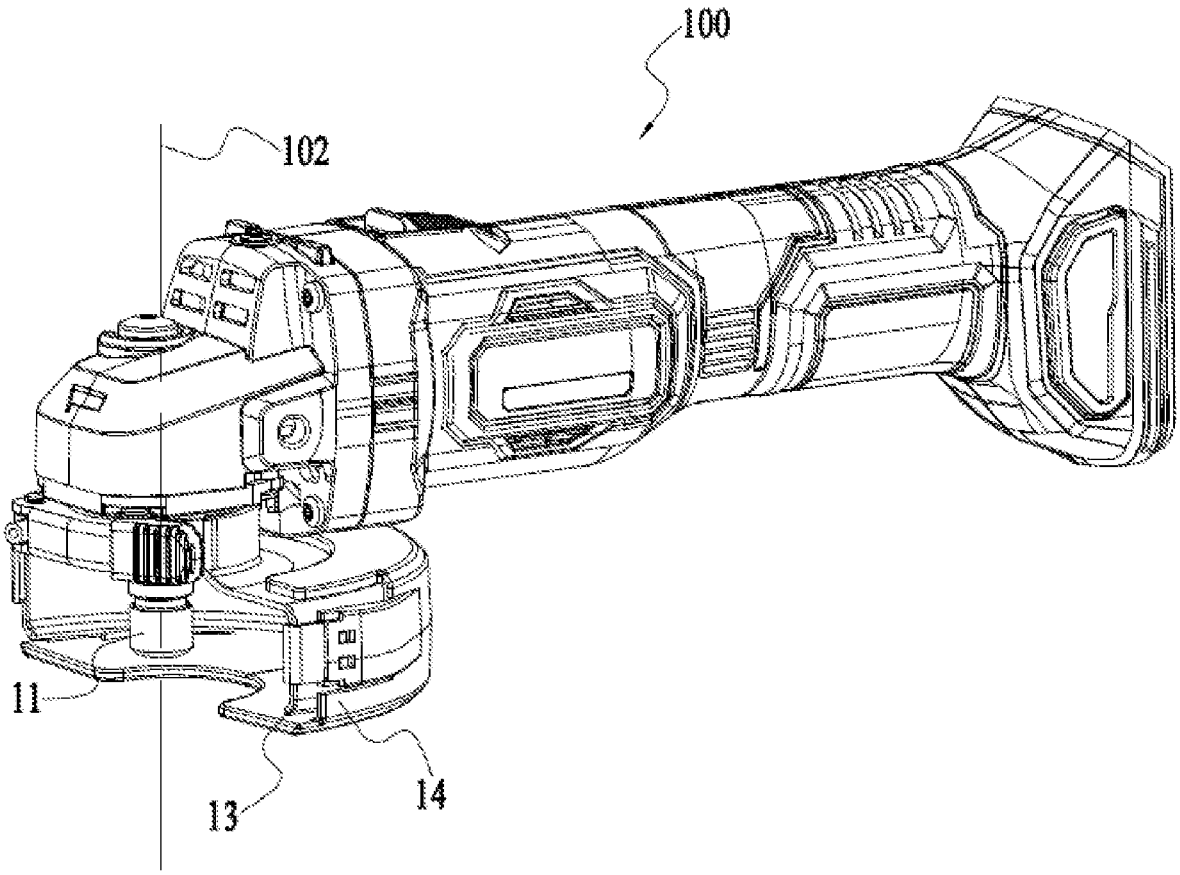
FIG. 2 is a schematic view of the angle grinder of FIG. 1 that is fitted with a first shield and a second shield.
Figure 3:
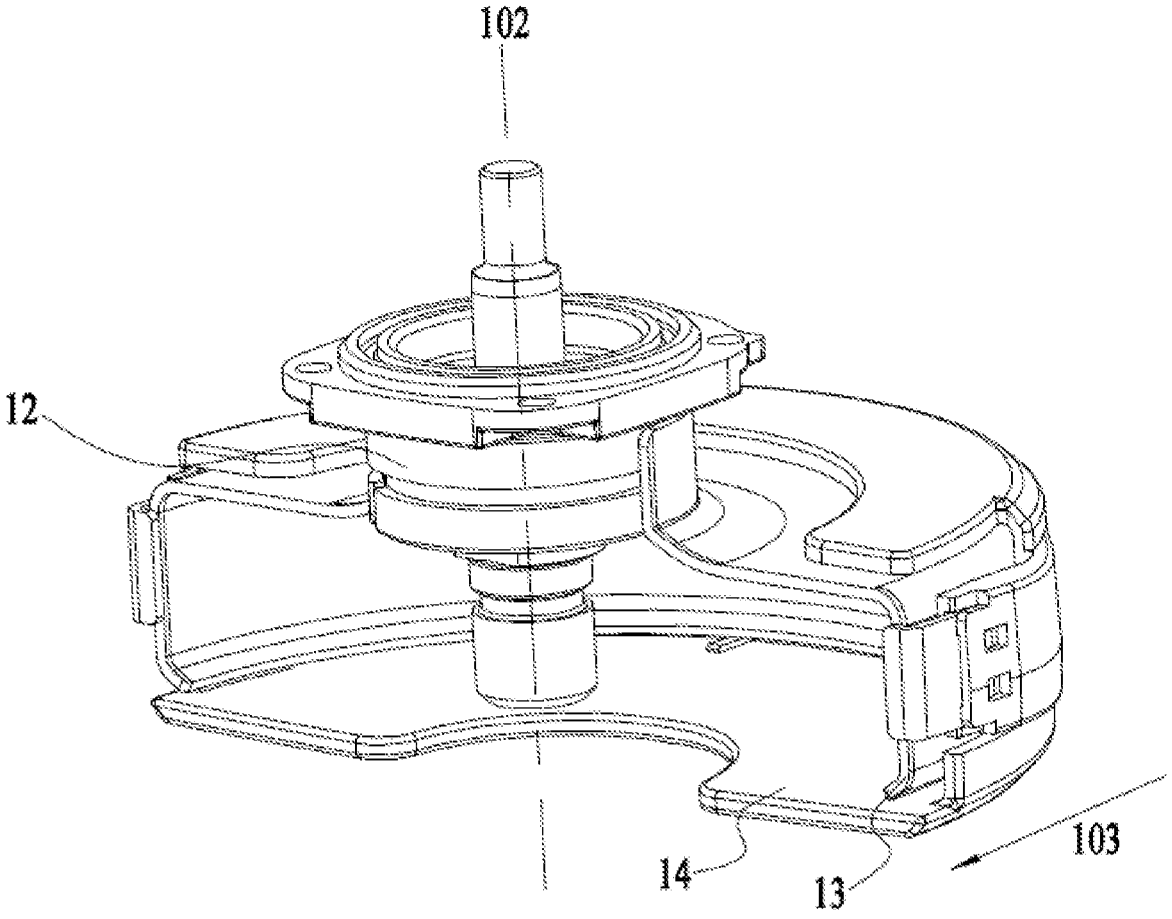
FIG. 3 is a schematic view illustrating the fitting of the first shield and the second shield of FIG. 2 onto a sleeve.

The angle grinder 100 of the first example shown in FIG. 1-3 includes a housing 10, an output shaft 11, a sleeve 12, a first shield 13, and a second shield 14. The output shaft 11 extends at least partially outside the housing 10, and the output shaft 11 is rotatable about a first axis 102 relative to the housing 10. The sleeve 12 is fixedly connected to the housing 10, and the output shaft 11 passes through the sleeve 12. A control switch is disposed on the housing 10, and the control switch can control the output shaft 11 to rotate or stop. The grip portion 101 is further formed on the portion of the housing 10. The first shield 13 is a half shield that is detachably connected to the sleeve 12, the locking element 121 is connected to the housing 10 and is capable of limiting movement of the first shield 13. The second shield 14 is combined with the first shield 13 to form a full protective shield, and the second shield 14 can be sleeved to the first shield 13 and detachably connected to the first shield 13.

When the angle grinder 100 is installed with a grinding element for friction work, effective protection of sparks, debris, etc. can be achieved only by installing the first shield 13. When the angle grinder 100 is mounted with a cutting disc for cutting work, full protection of the shield can be achieved when the second shield 14 is assembled with the first shield 13 as seen, for example, in FIG. 13.

The first shield 13, the second shield 14 and the manner of connection thereof will be specifically described below.

Figure 4:
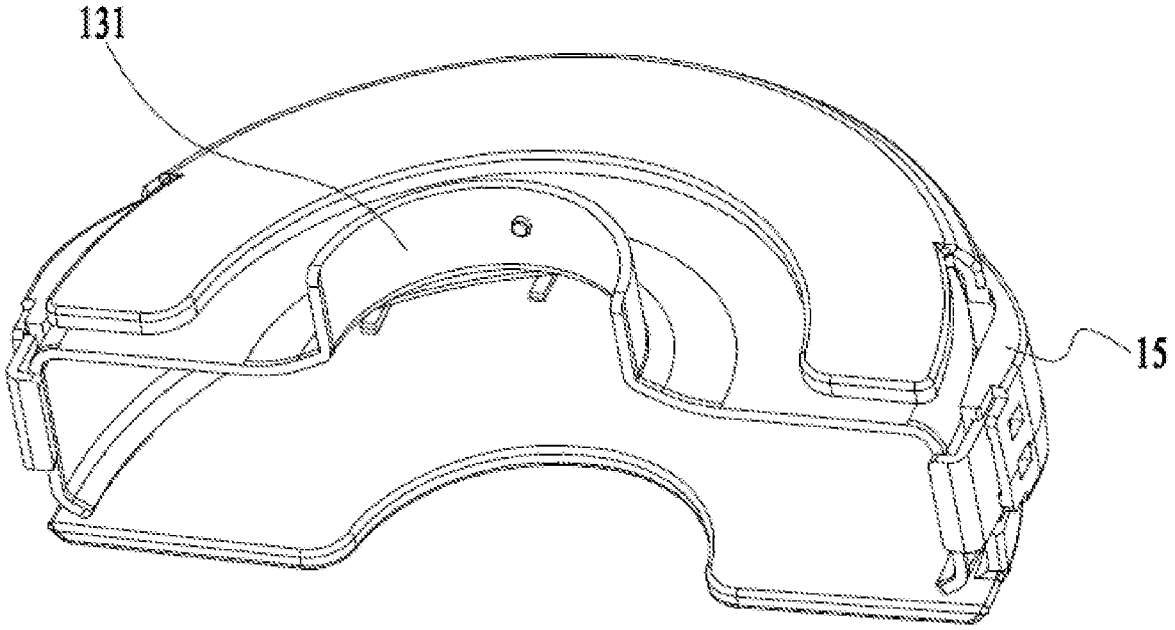
FIG. 4 is a schematic view illustrating the fitting together of the first shield and the second shield of FIG. 2.
Figure 5:
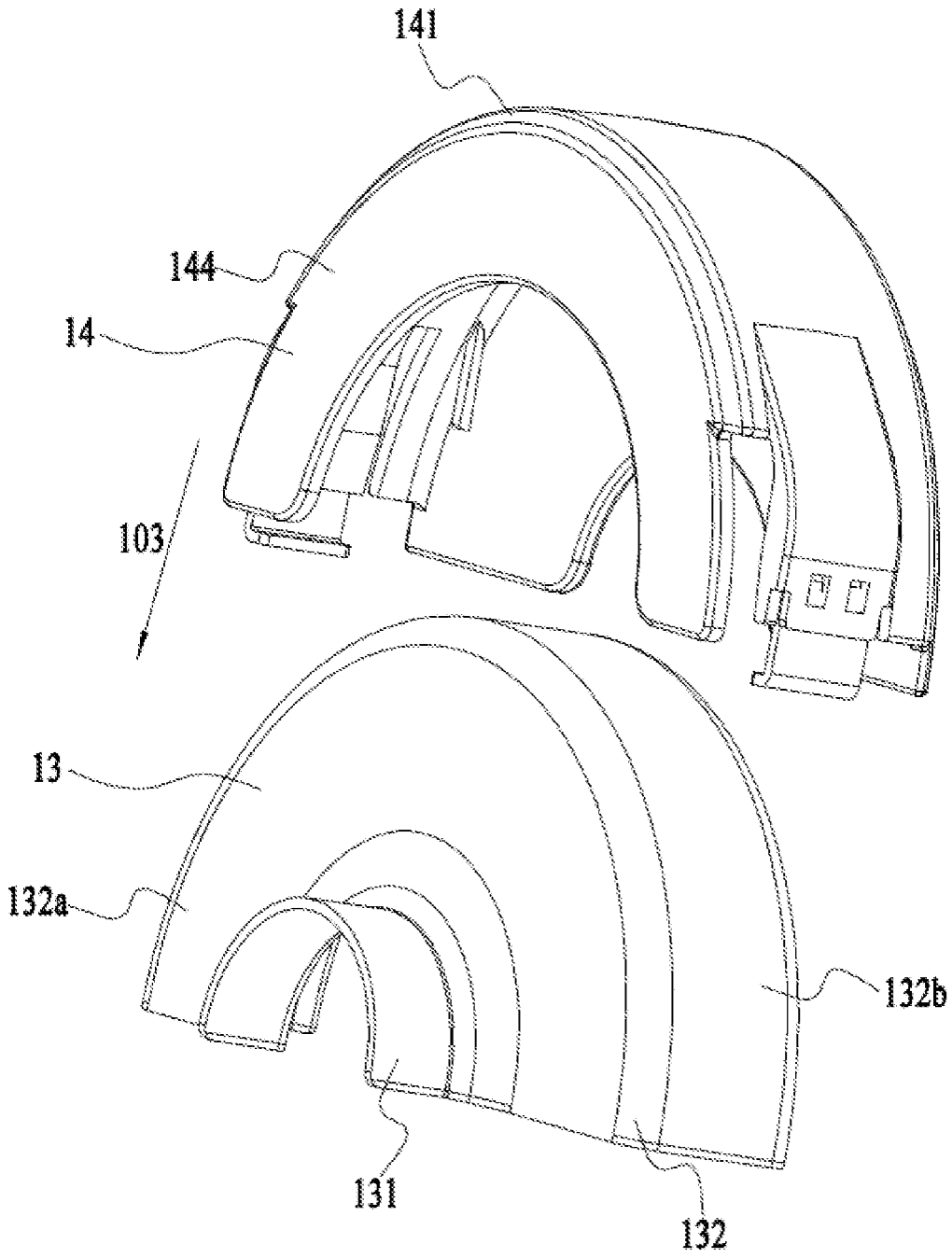
FIG. 5 is a schematic view illustrating the fitting together of the second shield of FIG. 2 onto the first shield along a first fitting direction.
Figure 6:
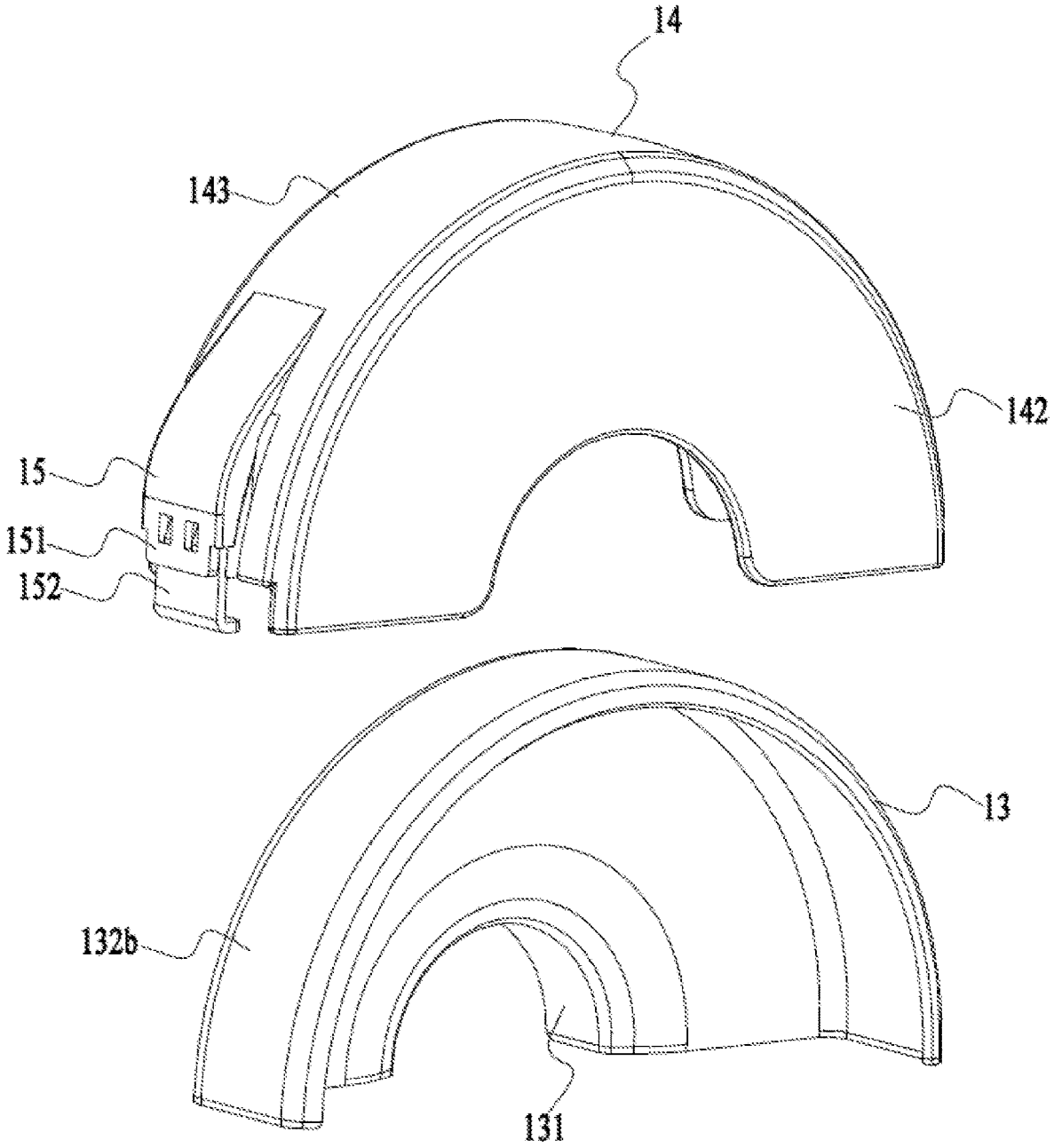
FIG. 6 is a schematic view illustrating the fitting of the second shield of FIG. 2 onto the first shield along the first fitting direction seen from another perspective.

The first shield 13 and the second shield 14 are illustrated by way of example in FIG. 4-6. The first shield 13 includes a journal 131 and a first cover 132 connected to one end surface of the journal 131 and the first shield 13 also encloses a first space opening toward the direction facing away from the first axis 102. The above-mentioned first cover 132 and the first space form a semi-protective form of the first shield 13 (i.e. one end facing the sleeve 12 is covered by the first cover 132, and the grinding disc is protected) and one end facing away from the sleeve 12 forms an open space. Specifically, the first cover 132 extends around the journal 131 and is formed with a first cover 132*a* and a second cover 132*b*. The first cover 132*a* extends around the journal 131 according to a predetermined size to form a semi-arc plane, and the first cover 132*a* is further bent along the axial direction and extends to a predetermined size to form the second cover 132*b*. When the first shield 13 is connected to the sleeve 12, the journal 131 is at least partially sleeved on the outer circumference of the sleeve 12. When assembled, the journal 131 and the sleeve 12 can be fixed in a variety of ways. In this example, after the journal 131 is sleeved on the outer circumference of the sleeve 12, the journal 131 is clamped to the sleeve 12 by pulling the wrench portion of the locking element 121. Of course, it is also possible that the journal 131 and the sleeve 12 have mutually fitting protrusions and sliding grooves, and the protrusions are displaced from the sliding groove after entering the sliding groove, and the protrusions enter the groove of the journal 131, thereby realizing the sleeve 12 and the limitation of the journal 131. No limit is present here however, as long as the functionality of the journal 131 can be achieved.

A second shield 14 surrounds the first shield 13 and is detachably connected to the first shield 13. The second shield 14 includes a connection assembly 15 for connecting with the first shield 13 and the second shield 141 for at least partially enclosing the first space. When the second shield 14 is connected to the first shield 13, the first shield 13 and the second shield 14 are collectively formed with a second space opening in a direction perpendicular to the first axis 102. Specifically, the second cover 141 includes a third cover 142 and a fourth cover 143. Presently, the third cover 142 is a semi-arc circle formed around the first axis 102 and the size of the circle is similar to that of the circle formed by the first cover 132*a* around the journal 131. The preset size of the third cover 142 is slightly larger than the first cover 132*a*. Further, the third cover 142 is axially bent at a circumferential position and extended to a predetermined size to form a fourth cover 143, thereby enabling the second shield 14 to sleeve the first shield 13. In this example, the second cover 141 is further formed with a fifth cover 144, which is disposed in parallel with the third cover 142. When the second shield 14 is mounted onto the first shield 13, the fifth shield 144 is actually located within a circumference surrounding the circumference of the journal 131 and away from the journal 131. And the third cover 142, the fourth cover 143, and the fifth cover 144 collectively form a second cover 141.

Figure 7:
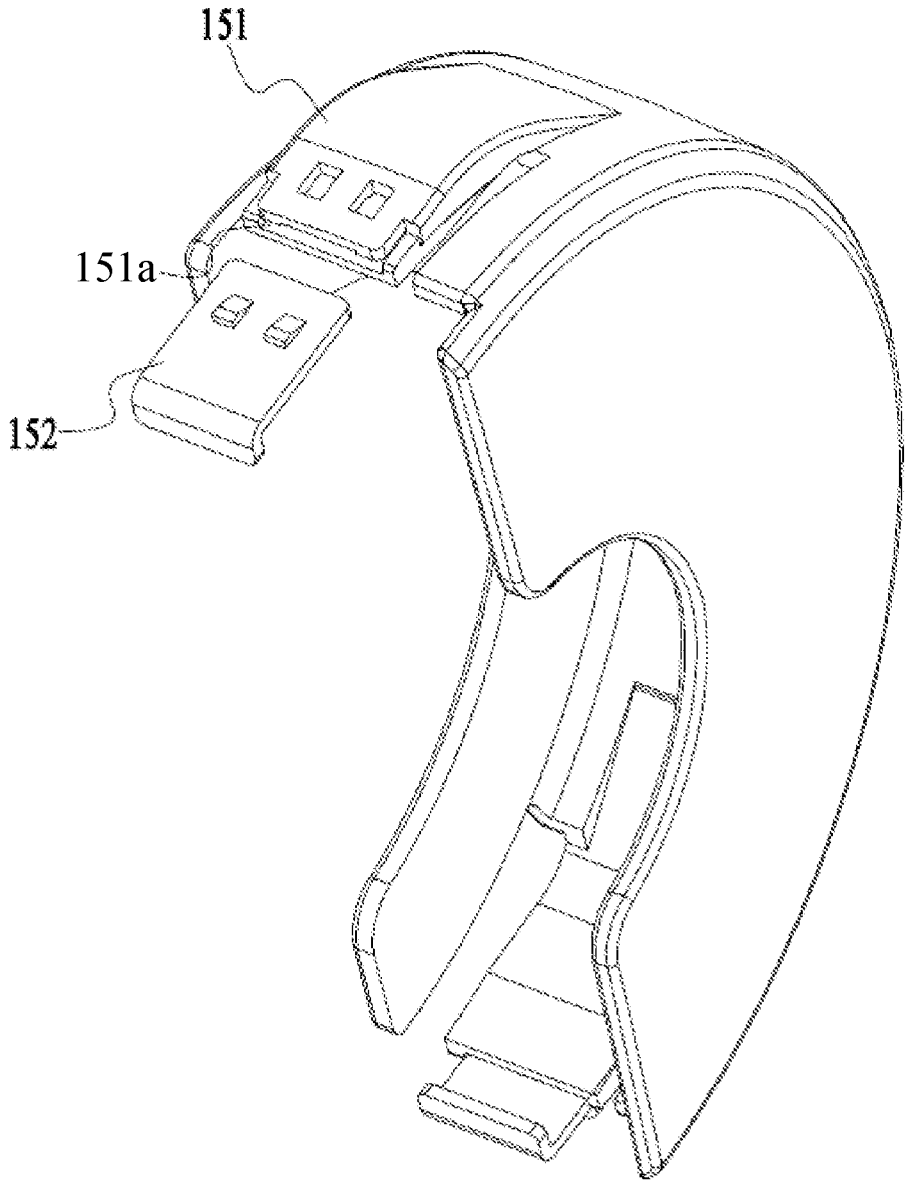
FIG. 7 is a schematic view illustrating the second shield of FIG. 2 where the connector is disengaged from the mounting element.

More specifically, the fourth cover 143 is further formed with a pair of connection assemblies 15 for connecting to the first shield 13. In this example, the connection assembly 15 includes a mounting element 151 integrally formed with the fourth cover 143 and a connector 152 detachably connected to the mounting element 151. As illustrated in FIGS. 6-7, the fourth cover 143 is provided with an opening at an end in the direction around the first axis 102, and the opening is provided with the mounting element 151 which is connected or integrally formed with the fourth cover 143, and the mounting element 151 at least partially protrudes from the curved surface where the fourth cover 143 is located or at least partially located in the curved surface where the fourth cover 143 is located, and the mounting element 151 inclines toward the first axis 102 and is elastic in nature. In this example, the mounting element 151 gradually extends from the opening and in a direction away from the first axis 102 gradually protrudes from the plane of the fourth cover 143. Further, the mounting element 151 continues to extend and gradually approaches a direction of the first axis 102 and is at least partially located in the plane of the fourth cover 143 and further forms a connection port 151*a* for connecting the connector 152. And the mounting element 151 forms a "bow" shaped member in the above-mentioned extending direction, and can provide a greater elastic force under the same structural strength. Specifically, the connection port 151*a* includes an upper cover 151*b* and a lower cover 151*c*. The upper cover 151*b* and the lower cover 151*c* are both extended from the body of the mounting element 151 by the connection port 151*a*, and the two form a first accommodation space 151*d* for accommodating the connector 152. The upper cover 151*b* is further formed with a card slot 151*e* for the limiting connector 152. In the example, the card slot 151*e* is two or more, and is not limited thereto, as long as the function of the connector 152 can be achieved.

Figure 8:
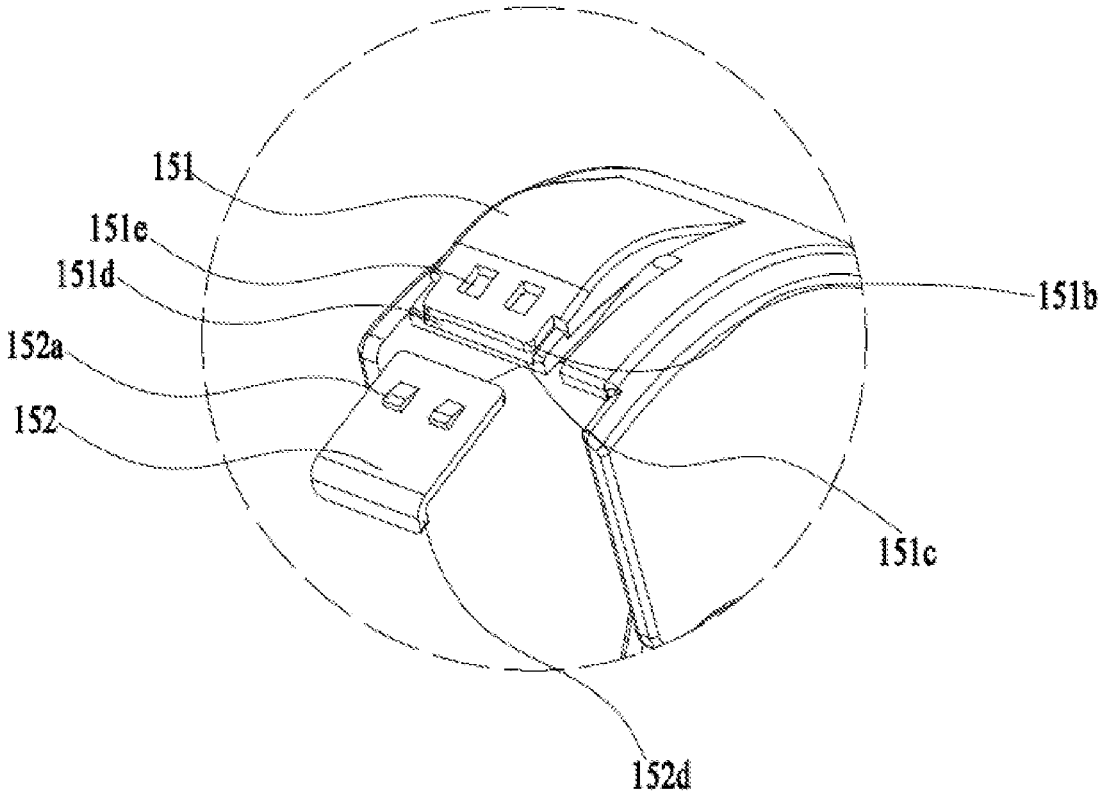
FIG. 8 is a partial enlarged view of the connector of FIG. 7 which is disengaged from the mounting element.
Figure 9:
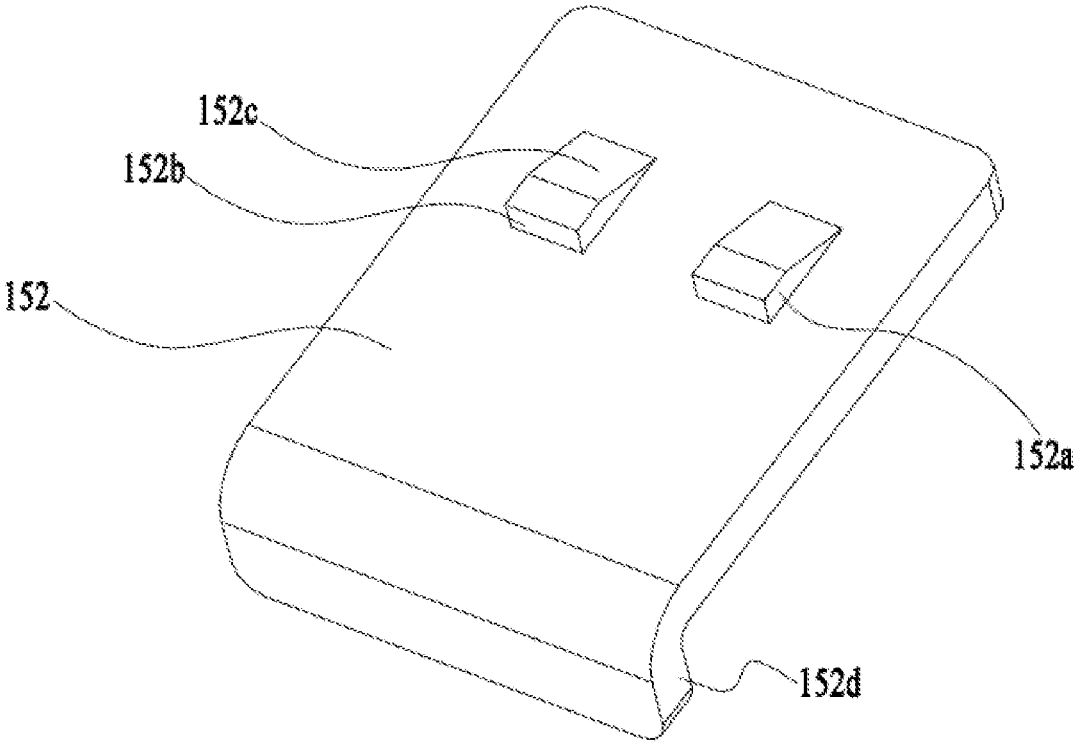
FIG. 9 is a schematic view of the connector of FIG. 7.
Figure 10:
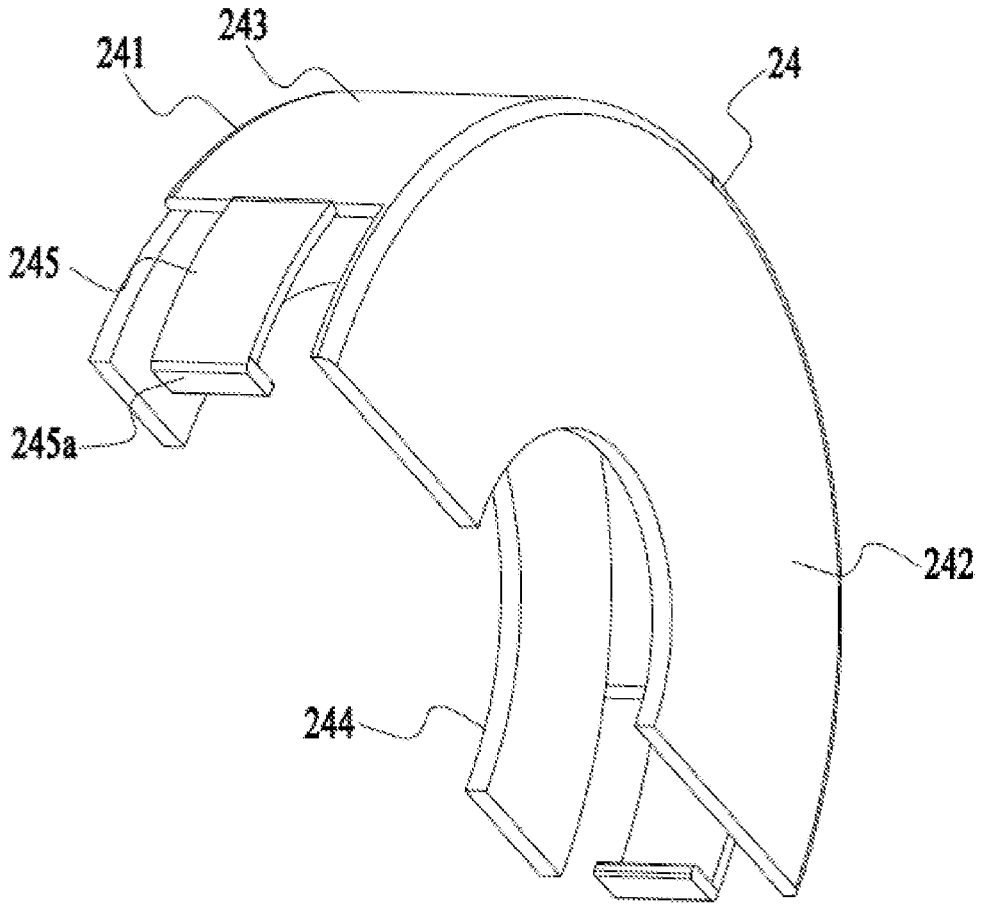
FIG. 10 is a schematic view illustrating a second example shield of an angle grinder.

As illustrated in FIG. 8-10, the connector 152 is an "L" shaped metal element, in this way, even if it encounters sparks or particles that tangentially fly out of the cutting disc, the high temperature resistant and wear resistant characteristics would enable the connector 152 not to easily fail under the action of high temperature or friction, and the problem that the common resin material cover is prone to high wear and tear is solved. Specifically, the connector 152 includes a first end and a second end, and the first end is formed with a convex portion 152*a* that is engaged with the card slot 151*e*. In this example, the number of the convex portions 152*a* is matched with that of the above-mentioned card slots 151*e*. More specifically, the convex portion 152*a* is formed with a stopper surface 152*b* for engaging with the card slot 151*e* to restrict the sliding motion of the connector 152, and a sliding surface 152*c* for feeding the convex portion 152*a* into the card slot 151*e*. When the connector 152 is assembled to the first accommodation space 151*d*, the upper cover 151*b* and the lower cover 151*c* are partially extended by the convex portion 152*a*, and the connector 152 slides in through the sliding surface 152*c* and finally enters the card slot 151*e*. Further, the entire convex portion 152*a* completely enters the card slot 151*e*, and the upper cover 151*b* and the lower cover 151*c* are restored to the original state. The convex portion 152*a* is the same size as the card slot 151*e*, and is completely restrained in the card slot 151*e*, and since the stopper surface 152*b* is parallel to the contact surface of the card slot 151*e*, the convex portion 152*a* is restrained and cannot be separated from the card slot 151*e*.

Further, due to the size of the first accommodation space 151*d*, the connector 152 does not continue to slide away from the card slot 151*e*, so that the connector 152 is completely restricted in the first accommodation space 151*d* without relative displacement and, at this moment, the connector 152 is formed integrally with the mounting element 151. Of course, it can be understood that, in order to meet the assembly requirements, the convex portion 152*a* can also be slightly smaller than the card slot 151*e*, and can freely move within the range of the card slot 151*e*, thereby, it is possible to satisfy the assembly requirement in a case where the mounting element 151 has a small elastic force.

The second end is formed with a buckle 152*d* that clamps the end of the second cover 132*b*. The mounting element 151 inclines toward the first axis 102 and has an elastic force, so when assembled to the mounting element 151, the connector 152 also inclines toward the first axis 102 and can transfer the elastic force of the mounting element 151, thereby clamping the first shield 13. It can be understood that the connector 152 may also be a plastic element, a resin element or other wear-resistant elements. When the connector 152 is a plastic element, a resin element or other accessories with weak wear resistance, compared to the metal element, since the above-mentioned accessory is lighter and the market price is lower, and the assembly property is high, therefore, the defect of insufficient wear resistance can be compensated by replacing the connector 152. Or it can be understood that when the connector 152 is a plastic element, a resin element or other accessories with weak wear resistance, the surface of the connector 152 can also be coated with a high temperature resistant and wear resistant coating to achieve the same effect as the metal part. In addition, since the plastic element and the resin element are lighter and more adapted to being assembled, the effect of the connector 152 coated with the high temperature resistant, wear resistant material can be viewed as performing better than the metal connector 152.

When the user operates the angle grinder 100 for friction work, the grinding element is loaded on the output shaft 11, at this moment, the protection requirement can be achieved just by installing the first shield 13. The first shield 13 achieves a half protection of the grinding element, i.e., forms a seal adjacent to the sleeve 12 and toward the user, forming an open first space in a direction facing away from the first axis 102.

When the user operates the angle grinder 100 for cutting work, the cutting disc is loaded on the output shaft 11, at this moment, due to the high protection requirements of the cutting operation, it is necessary to fully protect the cutting disc, therefore, on the basis of the first shield 13, the second shield 14 is sleeved to the first shield 13 in a first assembly direction 103 as illustrated. Since the second shield 14 has a pair of connection assembly 15, during the installation process, the buckle 152*d* of one of the connection assembly 15 is clamped to one end of the second cover 132*b* of the first cover 13, and the buckle 152*d* of the other connection assembly 15 is pressed to clamp the other end of the second cover 132*b*. Due to the elastic force of the connection assembly 15, the two connection assembly 15 will firmly clamp the two ends of the second covering 132*b*, So that the second shield 14 cannot be separated from the first shield 13 and deviated from the first assembly direction 103, thereby the second shield 14 is connected to the first shield 13. Since the third cover 142 and the fourth cover 143 of the second shield 14 cooperate with the first cover 132*a* of the first shield 13, a second accommodation space is formed. At this moment, the first shield 13 and the second shield 14 are integrally formed to form an open second space in a direction perpendicular to the first axis 102, so that the cutting disc is at least partially accommodated in the second accommodation space to form a full protection of the cutting disc.

FIG. 10 illustrates the second shield 24 in the angle grinder of the second example. In the present example, the main structure of the angle grinder is the same as that of the first example, except that the second shield 24 is different. Specifically, the second shield 24 may also have a second cover 241, a third cover 242 and a fourth cover 243 as in the first example. There is also a fifth cover 244 that is identical to the first example, except that the structure of the connection assembly in this example is different. The portions of the first example that are compatible with the present example can be applied to the present example. Only the differences between the present example and the first example will be described below.

In this example, the fourth cover 243 is provided with an opening at an end surrounding the first axial direction, and the opening is provided with the above-mentioned "L" shaped connector 245 fixedly connected to the fourth cover 243. The connector 245 at least partially protrudes from the curved surface of the fourth cover 243 or is at least partially located in the curved surface of the fourth cover 243, and is inclined toward the first axis direction and has an elastic force. In this example, the connector 245 is partially located on the curved surface of the fourth cover 243 and forms a buckle 245*a* for connecting the first shield. Due to the spark or particles flying out of the tangential direction of the cutting disc, the connector 245 is liable to fail under the action of high temperature or friction. Therefore, the connector 245 in the example is a metal element, which can effectively maintain the connection between the second shield 24 and the first shield under the action of high temperature or friction, and can effectively extend the service life of the second shield 24, thereby reducing replacement rate.

The above illustrates and describes basic principles, main features and advantages of the present disclosure. It is to be understood by those skilled in the art that the above examples do not limit the present disclosure in any form, and all solutions obtained by means of equivalent substitution or equivalent transformation fall within the protection scope of the present disclosure.

What is claimed is:

1. An angle grinder, comprising:

a housing;

an output shaft at least partially extending out of the housing and being rotatable relative to the housing about a first axis;

a sleeve fixedly connected to the housing, wherein the output shaft passes through the sleeve;

a first shield surrounding the output shaft and detachably connected to the sleeve, the first shield having a first end and a second end;

a second shield having a first end and a second end surrounding at least a part of the first shield and detachably connected to the first shield; and a first connector mounted to an outer surface of the first end of the second shield and configured for connecting the first end of the second shield to the first end of the first shield, a second connector mounted to an outer surface of the second end of the second shield and configured for connecting the second end of the second shield to the second end of the first shield, wherein the second shield comprises a first elastic mounting element proximate a first opening defined in the first end of the second shield, and a second elastic mounting element proximate a second opening defined in the second end of the second shield, the first elastic mounting element cooperating with the first connector to detachably connect the first end of the second shield to the first end of the first shield, and the second elastic mounting element cooperating with the second connector to detachable connect the second end of the second shield to the second end of the first shield, wherein the second shield further comprises a first connection port for connecting the first connector to the first elastic mounting element and the second shield further comprises a second connection port for connecting the second connector to the second elastic mounting element, wherein each of the first connector and the second connector is a metal element, wherein each of the elastic mounting elements at least partially protrudes from a curved surface and each of the elastic mounting elements inclines toward the first axis, and wherein each of the first connection port and the second connection port comprises an upper cover and a lower cover, the upper cover and the lower cover both extended from a body of the mounting element by the connection port, and the upper cover and the lower cover form an accommodation space.

2. The angle grinder according to claim 1, wherein each of the mounting elements is integrally formed with the second shield and the first and the second connectors and the first and the second mounting elements are detachably connected to each other, respectively.

3. The angle grinder according to claim 1, wherein the first shield forms a first space opening toward a direction facing away from the first axis when the first shield is mounted onto the sleeve and a whole of the first shield and the second shield forms a second space that opens in a direction perpendicular to the first axis when the second shield is mounted onto the first shield.

4. The angle grinder according to claim 1, wherein at least one of the connectors is operative to not be displaced relative to its respective mounting element when the at least one of the connectors is connected to its respective mounting element.

5. The angle grinder according to claim 1, wherein a coating is applied on a surface of at least one of the connectors.

6. The angle grinder according to claim 1, wherein at least one of the connectors is formed with a buckle that connects to the first shield.

7. The angle grinder according to claim 1, wherein at least one of the connectors is operative to be displaced relative to its respective mounting element when the at least one of the connectors is connected to its respective mounting element.

8. The angle grinder according to claim 1, wherein each of the upper covers further comprises a card slot and each of the first connector and the second connector includes a convex portion that is engageable with the card slot.

9. A shield assembly for an angle grinder with an output shaft, wherein the output shaft is rotatable about a first axis, comprising:

a first shield surrounding the output shaft and detachably connected to the angle grinder, the first shield having a first end and a second end;

a second shield having a first end and a second end and surrounding at least a part of the first shield, the first end of the second shield detachably connected to the first end of the first shield and the second end of the second shield detachably connected to the second end of the first shield; and a first connector configured for connecting the first end of the second shield to the first end of the first shield, a second connector configured for connecting the second end of the second shield to the second end of the first shield, wherein the second shield comprises a first elastic mounting element proximate a first opening defined in the first end of the second shield and a second elastic mounting element proximate a second opening defined in the second end of the second shield, the first mounting element being cooperable with the first connector to detachably connect the second shield and the first shield, the second mounting element being cooperable with the second connector to detachably connect the second shield and the first shield, wherein the second shield further comprises a first connection port for connecting the first connector to the first elastic mounting element and the second shield further comprises a second connection port for connecting the second connector to the second elastic mounting element, wherein each of the first connector and the second connector is a metal element, wherein each of the mounting elements at least partially protrudes from a curved surface and inclines toward the first axis, and wherein each of the first connection port and the second connection port comprises an upper cover and a lower cover, the upper cover and the lower cover both extended from a body of the mounting element by the connection port, and the upper cover and the lower cover form an accommodation space.

10. The shield assembly according to claim 9, wherein at least one of the mounting elements is integrally formed with the second shield and the at least one of the mounting elements is detachably connected to its respective connector.

11. The shield assembly according to claim 9, wherein the first shield forms a first space opening toward a direction facing away from the first axis when the first shield is mounted onto the angle grinder and a whole of the first shield and the second shield forms a second space that opens in a direction perpendicular to the first axis when the second shield is mounted onto the first shield.

12. The shield assembly according to claim 9, wherein at least one of the connectors is operative to not be displaced relative to its respective mounting element when the at least one of the connectors is connected to its respective mounting element.

13. The shield assembly according to claim 9, wherein a coating is applied on a surface of at least one of the connectors.

14. The shield assembly according to claim 9, wherein at least one of the connectors is formed with a buckle that connects to the first shield.

15. The shield assembly according to claim 9, wherein at least one of the connectors is operative to be displaced relative to its respective mounting element when the at least one of the connectors is connected to its respective mounting element.

* * * * *